US008203319B2

(12) United States Patent
Fujita et al.

(10) Patent No.: US 8,203,319 B2
(45) Date of Patent: Jun. 19, 2012

(54) TRANSFORMER ON-LOAD TAP CHANGER USING MEMS TECHNOLOGY

(75) Inventors: Lincoln Mamoru Fujita, Roanoke, VA (US); Kanakasabapathi Subramanian, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 498 days.

(21) Appl. No.: 12/500,212

(22) Filed: Jul. 9, 2009

(65) Prior Publication Data

US 2011/0005910 A1 Jan. 13, 2011

(51) Int. Cl.
*G05F 1/14* (2006.01)

(52) U.S. Cl. ..... 323/255; 323/340

(58) Field of Classification Search ..... 323/255–258, 323/340, 341, 343
See application file for complete search history.

(56) References Cited

U.S. PATENT DOCUMENTS

| | | | | |
|---|---|---|---|---|
| 3,167,703 | A | 1/1965 | Schindler | |
| 3,581,188 | A | 5/1971 | Watanabe et al. | |
| 5,408,171 | A | 4/1995 | Eitzmann et al. | |
| 5,523,535 | A | 6/1996 | Larsson et al. | |
| 7,332,835 | B1 | 2/2008 | Wright et al. | |
| RE41,814 | E * | 10/2010 | Owen | 336/150 |
| 2004/0100341 | A1 * | 5/2004 | Luetzelschwab et al. | 333/32 |
| 2006/0274470 | A1 | 12/2006 | Srinivasan et al. | |
| 2007/0139145 | A1 | 6/2007 | Subramanian et al. | |
| 2007/0139829 | A1 | 6/2007 | Arthur et al. | |
| 2007/0139830 | A1 * | 6/2007 | Premerlani et al. | 361/2 |
| 2007/0139831 | A1 | 6/2007 | Wright et al. | |
| 2008/0137238 | A1 | 6/2008 | Wright et al. | |
| 2008/0164961 | A1 | 7/2008 | Premerlani et al. | |
| 2008/0165457 | A1 | 7/2008 | Premerlani et al. | |
| 2008/0169707 | A1 | 7/2008 | Wright et al. | |
| 2009/0230933 | A1 * | 9/2009 | Oates et al. | 323/258 |

OTHER PUBLICATIONS

European Search Report for Application No. 10168517.0; Mailed Jan. 17, 2011.

* cited by examiner

*Primary Examiner* — Gary L Laxton
*Assistant Examiner* — Gustavo Rosario Benitez
(74) *Attorney, Agent, or Firm* — Cantor Colburn LLP

(57) ABSTRACT

An on-load tap changer (OLTC) for a transformer winding is disclosed. The OLTC includes a first MEMS switch coupled in series with a first tap on the transformer winding and a neutral terminal. The OLTC also includes a second MEMS switch coupled in series with a second tap on the transformer winding and the neutral terminal. The OLTC further includes a controller coupled to the first MEMS switch and the second MEMS switch, the controller configured to coordinate the switching operations of the first MEMS switch module and the second MEMS switch module to obtain a first predetermined turns ratio or a second predetermined turns ratio for the transformer winding.

17 Claims, 4 Drawing Sheets

TRANSFORMER ON-LOAD TAP CHANGER USING MEMS TECHNOLOGY

BACKGROUND OF THE INVENTION

The subject matter disclosed herein relates to on-load tap changers for high voltage devices, and specifically to on-load tap changers for a high power transformer utilizing micro-electromechanical system (MEMS) technology.

Currently, a complex mechanical switching assembly accomplishes on-load tap changers (OLTC). Mechanical OLTC mechanisms include an electric motor for charging powerful springs to open and close switches in the switching assembly of these OLTC mechanisms. The switches in the switching assembly are mechanically actuated on and off in a sequence coordinated by mechanical interlocks to orchestrate the switch openings and closings with the correct timing. These mechanical interlocks can bind and prevent switching from occurring. Although much development has been done to reduce switch contact electrical stress (such as reducing arcing when each switch opens), a main failure mode is switch contact failure. Furthermore, because the OLTC switch assembly has many integrated and mechanical moving parts, it has frequent problems and must be maintained regularly which can be costly. Furthermore, because the conventional OLTC switch assembly is immersed in an insulating media such as oil or SF6 gas to reduce the arcing problem, the maintenance on OLTC switch assembly can be costly and time consuming. Mechanical OLTC mechanisms are also large, slow and noisy, which may be undesirable. The mechanical moving parts of the conventional OLTC are the source of a significant portion of the problems in power transformers that include an OLTC.

Solid-state switching devices have been used to reduce a few failure modes, but are known to have other failures or disadvantages when used as a switching component in a transformer on-load tap changer application. It is well known that semiconductor switching means exhibit parasitic energy losses and undesirable off-state leaks. Semiconductor switches also have forward voltage drop even when they are on. When a semiconductor switch is in an open position it still lets through a little bit of current, which is undesirable. Although solid-state switches can provide high switching speeds, they suffer from significant power losses and can be very costly.

Accordingly, it is desirable to have an on-load tap changer for a high powered transformer using switching technology that is cost-effective and is capable of switching less than one micro-second and in a fashion to be arcless by diverting the energy. It is further desirable to have an on-load tap changer for a high-powered transformer using switching technology that can reduce or eliminate the switching failure modes of a conventional switch and eliminate the parasitic energy losses of a semiconducting switching means.

BRIEF DESCRIPTION OF THE INVENTION

According to one aspect of the invention, an on-load tap changer for a transformer winding is provided. The OLTC includes a first micro-electromechanical system (MEMS) switch module directly coupled in series with a first tap on the transformer winding and a neutral terminal; a second MEMS switch module directly coupled in series with a second tap on the transformer winding and the neutral terminal; and a controller operably coupled to the first MEMS switch module and the second MEMS switch module, the controller is configured to generate a first and second signal to be received by the first and second MEMS switch modules respectively to induce the first MEMS switch module to transition to a closed position and induce the second MEMS switch module to transition to an open position to obtain a first predetermined turns ratio on the transformer winding at a first time, the controller further configured to generate a third signal to the second MEMS switch module to induce the second MEMS switch module to transition to a closed position at a second time after the first time, the controller further configured to generate a fourth signal to be received by the first MEMS switch module at a third time after the second time, the first MEMS switch module configured to transition from the closed position to an open position at a detected zero crossing of an alternating current in response to the fourth signal to obtain a second predetermined turns ratio on the transformer winding.

According to another aspect of the invention, an OLTC for a transformer winding is provided. The on-load tap changer includes a first micro-electromechanical system (MEMS) switch module directly coupled in series with a first tap on the transformer winding and a neutral terminal; a second MEMS switch module directly coupled in series with a second tap on the transformer winding and the neutral terminal; a controller operably coupled to the first MEMS switch module and the second MEMS switch module, the controller is configured to generate a first and second signal to be received by the first and second MEMS switch modules respectively to induce the first MEMS switch module to transition to a closed position and induce the second MEMS switch module to transition to an open position to obtain a first predetermined turns ratio on the transformer winding at a first time, the controller further configured to generate a third signal to the second MEMS switch module to induce the second MEMS switch module to transition to a closed position at a second time after the first time, the controller further configured to generate a fourth signal to be received by the first MEMS switch module at a third time after the second time, the first MEMS switch module configured to transition from the closed position to an open position at a detected zero crossing of an alternating current in response to the fourth signal to obtain a second predetermined turns ratio on the transformer winding; and control circuitry coupled to the first MEMS switch module and the second MEMS switch module, the control circuitry configured to prevent the creation of high circulating current between transformer windings when the first MEMS switch module and the second MEMS switch module are each in the closed position.

According to yet another aspect of the invention, a method for assembling an OLTC for a transformer winding is provided. The method includes coupling a first micro-electromechanical system (MEMS) switch module in series with a first tap on the transformer winding and a neutral terminal; coupling a second MEMS switch module coupled in series with a second tap on the transformer winding and the neutral terminal; and operably coupling a controller to the first MEMS switch module and the second MEMS switch module, the controller is configured to generate a first and second signal to be received by the first and second MEMS switch modules respectively to induce the first MEMS switch module to transition to a closed position and induce the second MEMS switch module to transition to an open position to obtain a first predetermined turns ratio on the transformer winding at a first time, the controller further configured to generate a third signal to the second MEMS switch module to induce the second MEMS switch module to transition to a closed position at a second time after the first time, the controller further configured to generate a fourth signal to be received by the first MEMS switch module at a third time after the second time, the first MEMS switch module configured to transition from the closed position to an open position at a detected zero crossing of an alternating current in response to the fourth signal to obtain a second predetermined turns ratio on the transformer winding.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Exemplary embodiments are directed to an OLTC that utilizes MEMS switch technology (e.g., independent MEMS based switches) for changing the amount of turns or turns ratio on a transformer winding, and effectively the output voltage of the alternating current (AC) across the transformer winding and a method for assembling the same. Exemplary embodiments are also directed to a method for operating an OLTC that utilizes MEMS switch technology to change the turns ratio on a transformer winding. In the exemplary embodiments, the use of MEMS switches reduce or eliminate switching failure modes (e.g., switch contact failure) of a conventional switch and avoid the parasitic energy losses of a semiconducting switching means. The exemplary embodiments provide an OLTC that utilizes MEMS switches capable of switching in less than one microsecond and include an embedded method to eliminate arcing as the switches are opened.

As used herein, the terms "off", "on", "open", "closed", "series", and "parallel" have their ordinary meaning in the electronic arts.

Figure 1:
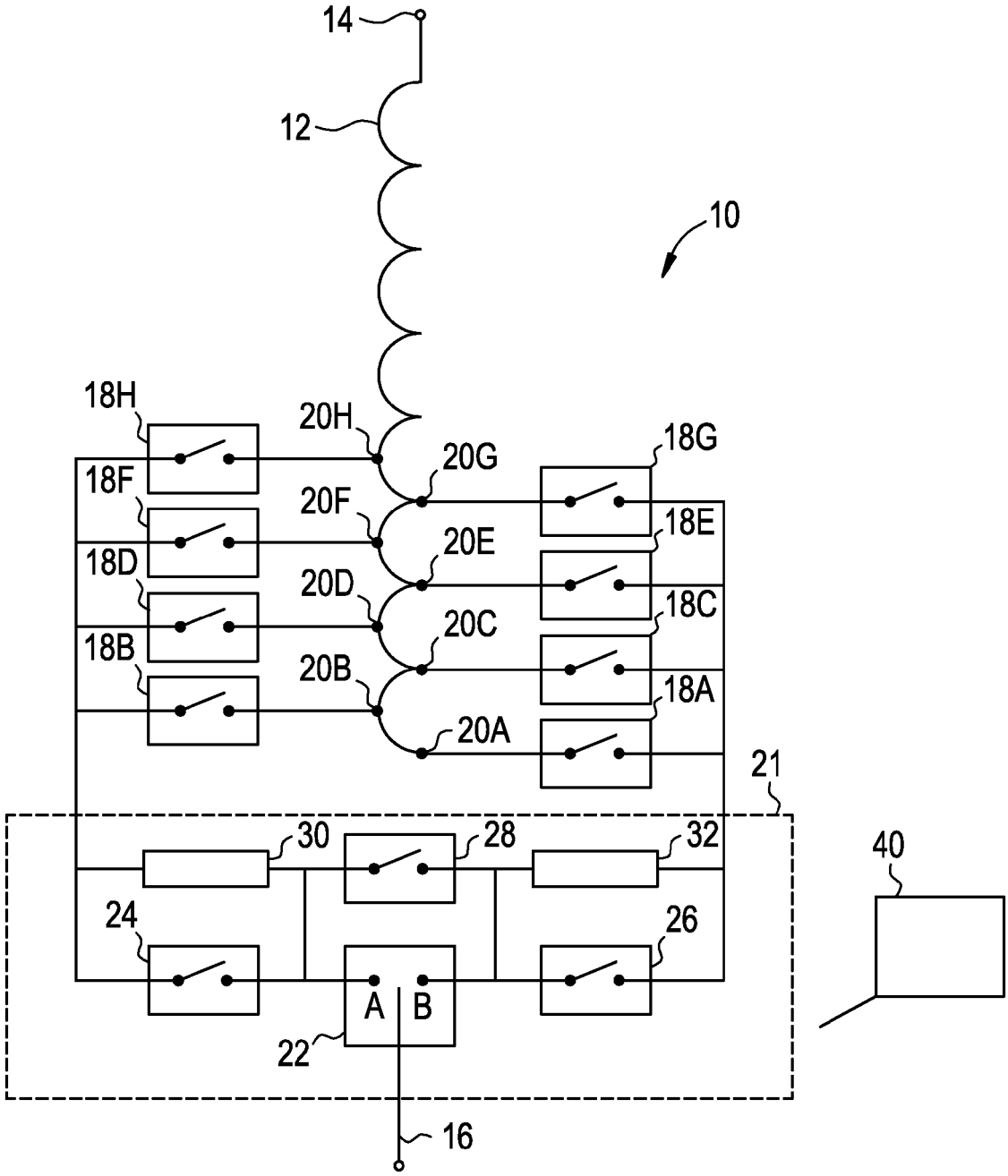
FIG. 1 is a schematic diagram of an OLTC for a transformer winding utilizing a plurality MEMS of switch modules in accordance with an exemplary embodiment as disclosed herein.

FIG. 1 illustrates a simplified schematic of an on-load tap changer 10 coupled to a transformer winding 12 of a transformer unit (not shown) having an internal coil and core assemblies (not shown) in accordance with one exemplary embodiment. Although the components of the transformer unit are not shown in detail, it should be understood that the transformer winding 12 as described herein can be part of any conventional transformer unit and should not be limited to any one type of transformer configuration. The transformer winding 12 has a line terminal 14 at one end and a neutral or ground terminal 16 at the other end.

The on-load tap changer 10 includes a plurality of MEMS switch modules 18A-18H electrically coupled directly in series with a plurality of taps 20A-20H respectively, where the taps are connected to different transformer windings as shown. Each tap allows a predetermined number of turns to be selected for the transformer winding providing the transformer winding with a variable turns ratio and enabling voltage regulation of the AC output across the transformer winding. In general, for example, when MEMS switch module 18B closes to make a tap connection with tap 20B while the other MEMS switch modules are open, the transformer winding 12 will obtain a first predetermined turns ratio. In this same example, when MEMS switch module 18C closes to make a tap connection with tap 20C while the other MEMS switch modules (including MEMS switch module 18A) are open, the transformer winding 12 will obtain a second predetermined turns ratio different from the first predetermined turns ratio. As such, the voltage output of the transformer winding 12 can be "stepped down" or increased (e.g., moving from tap 20B to tap 20A) or "stepped up" or decreased (e.g., moving from tap 20B to tap 20C) accordingly. Only one MEMS switch module may be closed during normal transformer operation in accordance with one embodiment.

The on-load tap changer 10 may include more or less MEMS switch modules and taps than are shown in FIG. 1 depending on the application. However, for purposes of simplification only, eight modules are shown in FIG. 1. For ease of discussion, MEMS switch module 18B and MEMS switch module 18C along with their respective taps (tap 20B and tap 20C) will be discussed in greater detail to illustrate, by way of example, the switching operations of the on-load tap changer 10 utilizing MEMS switch technology in accordance with one exemplary embodiment.

The on-load tap changer 10 further includes control circuitry 21 electrically coupled between the plurality of MEMS switch modules and the neutral terminal 16 as shown. The control circuitry 21 is configured to prevent large circulating current between windings during a tap switching operation in accordance with one embodiment. In other words, the control circuitry controls the switching operation and operably diverts undesired energy from the transformer winding during a tap switching operation, which will be discussed in greater detail below.

The control circuitry 21 includes a first diverter switch module 22, a second diverter switch module 24, a third diverter switch module 26, a fourth diverter switch module 28. The control circuitry 21 further includes a first and second diverter impedance 30, 32 used to dissipate undesired energy from the transformer windings during a tap switching operation. A discussion of these components with reference only to MEMS switch module 18B and 18C is provided as an example of their operation; however, they may be used in conjunction with any of the MEMS switch modules described herein. The first diverter switch module 22 is electrically coupled between MEMS switch module 18B and neutral terminal 16. The first diverter switch module 22 is also electrically coupled between MEMS switch module 18C and neutral terminal 16. The first diverter switch module 22 is configured to transition between a first operational position and a second operational position depending on the desired turns ratio for the transformer winding. The second diverter switch module 24 is electrically coupled between MEMS switch module 18B and the first diverter switch module 22. The first diverter impedance is electrically coupled in parallel with the second diverter switch module 24 and is electrically coupled to MEMS switch module 18B as shown. The third diverter switch module 26 is electrically coupled between MEMS switch module 18C and the first diverter switch module 22. The second diverter impedance 32 is electrically coupled in parallel with the third diverter switch module 26. Finally, the fourth diverter switch module 28 is electrically coupled in series with the first diverter impedance 30 and the second diverter impedance 32 and is in parallel connection with the first diverter switch module 22.

In accordance with one exemplary embodiment, a controller 40 is in signal communication with the MEMS switch modules 18A-18H and the diverter switch modules 22, 24, 26 and 28. The controller 40 is configured to coordinate the switching operations of the MEMS switch modules and the diverter switch modules in order to create (e.g. close) tap connections, break tap connections (e.g., open), prevent tap connections, as well as switch between taps (e.g., open and close sequences) to effectively change or adjust the level of voltage available at the transformer winding to the neutral terminal, by generating and sending signals to the MEMS switch modules and the diverter switch modules to induce the switch modules to open or close at a predetermined time in accordance with one exemplary embodiment. The controller 40 sends signals to the MEMS switch modules and diverter switch modules in accordance with predetermined switching sequences to make tap connections, break tap connections, prevent tap connections, and switch between taps. The controller 40 is configured to receive feedback (e.g., switch position) from each of the MEMS switch modules in accordance with one embodiment.

The controller 40 can be an integral component of the on-load tap changer 10 in accordance with one exemplary embodiment. In an alternate embodiment, the controller 40 is a component of a system or sub-system that incorporates the transformer unit with the on-load tap changer 10. In accordance with one exemplary embodiment, the controller 40 comprises a processor having a combination of hardware and/or software/firmware with a computer program that, when loaded and executed, permits the processor of the controller to operate such that it carries out the methods/operations described herein.

The switching sequences executed by the controller 40 will now be discussed by way of example with reference to the on-load tap changer configuration shown in FIG. 1 and described above. More specifically, a normal transformer operation and a tap switching operation executed by the controller 40 will be described by way of example. This will illustrate the operation of the on-load tap changer 10 that can create a tap connection before releasing another tap connection, which in this example is between tap 20B to tap 20C, utilizing MEMS switch technology.

Figure 2:
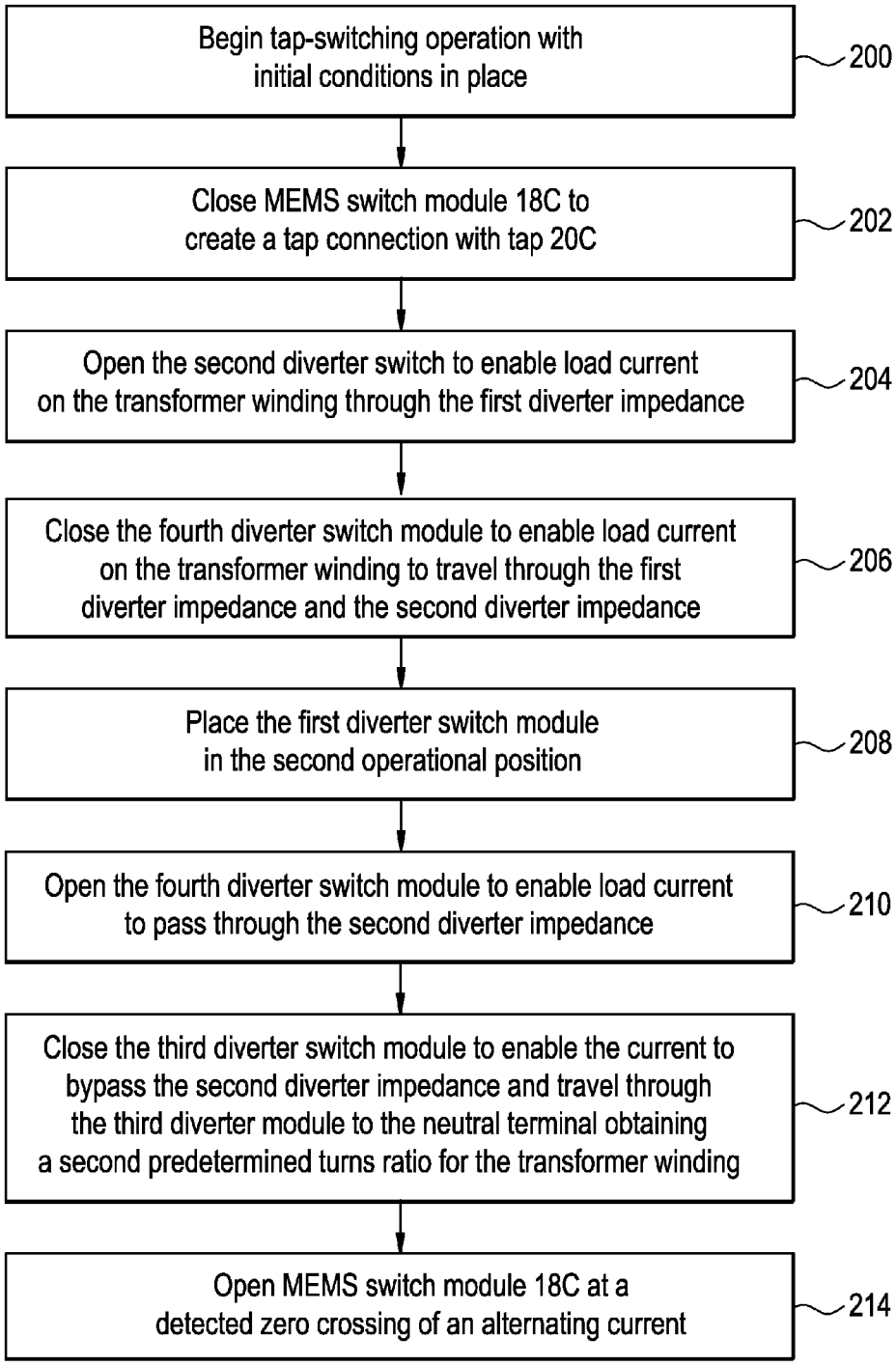
FIG. 2 is a flow diagram that provides a method for operating an OLTC that utilizes MEMS switch technology to change the turns ratio on a transformer winding in accordance with an exemplary embodiment as disclosed herein.

Now referring to FIG. 2, a method for operating an OLTC that utilizes MEMS switch technology to change the turns ratio on a transformer winding in accordance with one exemplary embodiment will be discussed by way of example with reference to the OLTC shown in FIG. 1.

At operational block 200, begin a tap-switching operation with initial conditions in place. The initial conditions that are in place includes MEMS switch module 18B being closed making a connection with tap 20B while MEMS switch module 18C is open (and all other tap switches, 18A, 18D-18H are open), the first diverter switch module 22 being placed in the first operational position (position A), the second diverter switch module 24 being closed, and the third and fourth diverter switch module 26, 28 being open. With these initial conditions, the transformer winding 12 is operating in a normal operational mode and a first predetermined turns ratio is obtained for the transformer winding 12. During these initial conditions, load current is traveling through the second diverter switch module 24 to neutral terminal 16. The controller 40 enables these initial conditions to be met by generating and sending signals to the switching components in a predetermined sequence in accordance with one exemplary embodiment. Of course, the initial conditions set in place could be where MEMS switch module 18C is closed and the MEMS switch module 18B is open or where any one of the MEMS switch modules are closed while the remaining are open. However, only the initial conditions described above will be used in this example for the sake of discussion.

At operational block 202, close MEMS switch module 18C to create a tap connection with tap 20C. The MEMS switch module 18C closes by receiving a signal from the controller 40 that induces the MEMS switch module 18C to close in accordance with one exemplary embodiment. At this point, a tap switching operation has been initiated by controller 40 in accordance with one embodiment.

At operational block 204, open the second diverter switch module 24 to enable load current on the transformer winding to travel through the first diverter impedance 30. This enables the energy at MEMS switch module 18B to dissipate through first diverter impedance 30. The controller 40 sends a signal to the second diverter switch module 24 to induce the second diverter switch module 24 to open in accordance with one exemplary embodiment.

At operational block 206, close the fourth diverter switch module 28 to enable load current on the transformer winding to travel through the first diverter impedance 30 and the second diverter impedance 32. The first diverter impedance 30 and the second diverter impedance 32 are used to divert the energy stored in the windings between MEMS switch module 20B and MEMS switch module 20C in accordance with one exemplary embodiment. The fourth diverter switch module 28 closes by receiving a signal from the controller 40 to induce the fourth diverter switch module 28 to close in accordance with one exemplary embodiment.

At operational block 208, place the first diverter switch module 22 in the second operational position (position B). This will enable load current to travel between the second MEMS switch module 18C and the neutral terminal 16 and enable the transformer winding to obtain a second predetermined turns ratio.

At operational block 210, open the fourth diverter switch module 28 to enable load current to pass through the second diverter impedance 32. This enables the energy at MEMS switch module 18C to dissipate through second diverter impedance 32. The fourth diverter switch module 28 opens by receiving a signal from the controller 40 to induce the fourth diverter switch module 28 to open in accordance with one exemplary embodiment.

At operation block 212, close the third diverter switch module 26 to enable load current to bypass the second diverter impedance 32 and travel through the third diverter switch module 26 to the neutral terminal 16 obtaining a second predetermined turns ratio for transformer winding 12. The third diverter switch module 26 closes by receiving a signal from the controller 40 to induce the third diverter switch module 26 to close in accordance with one exemplary embodiment.

At operation block 214, open MEMS switch module 18B at a detected zero crossing of the alternating current. This completes the tap switching operation. In accordance with one embodiment, MEMS switch module 18B opens at the detected zero crossing of the alternating current in response to receiving a signal from the controller to induce the MEMS switch module 18B to open.

The flow diagram depicted herein is just an example. There may be many variations to this diagram or the steps (or operations) described therein without departing form the spirit of the invention. For instance, the operational steps may be performed in a differing order, or steps may be added, deleted or modified. All these variations are considered a part of the claimed invention. It should be understood that similar operational steps can be taken to form different tap connections along the transformer winding.

In accordance with one exemplary embodiment, each of the MEMS switch modules comprises one or more MEMS based switches configured to open during a detected zero crossing of an alternating current or bypass asymmetric current through a bypass method. In accordance with one embodiment, the MEMS based switches described herein include an integral current sensor that can detect the zero crossing of the alternating current. Furthermore, the MEMS based switches described herein are configured to have zero leakage in the open position in accordance with one embodiment.

In accordance with one exemplary embodiment, each of the diverter switch modules comprises one or more MEMS based switches similar to those described above.

In accordance with one exemplary embodiment, each MEMS switch module comprises of an array of MEMS based switches having a series configuration, a parallel configuration or a combination of both. It is contemplated that such MEMS based switches alone or in combination with other MEMS based switches used in this OLTC application can withstand high voltage/high current transformers without failing.

Figure 3:
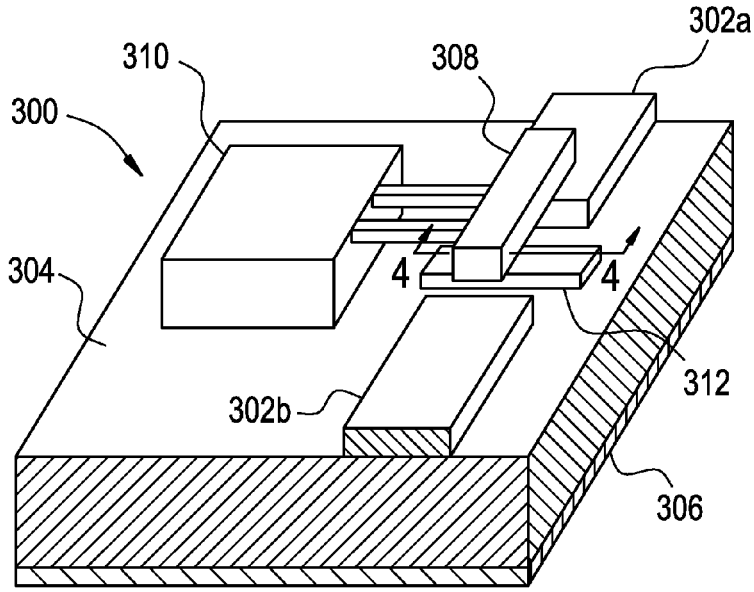
FIG. 3 is a perspective view showing the structure of an exemplary MEMS switch for each of the plurality of MEMS switch modules in accordance with one exemplary embodiment as disclosed herein.

Now referring to FIG. 3 illustrating one example of a MEMS switch 300 and its basic components that can be used in the exemplary embodiments described herein. The MEMS switch 300 comprises a switch movable element 308, support structure 310, and switch electrode (driving means) 312. The MEMS switch 300 is formed on a dielectric substrate 304 together with two RF microstrip lines (distributed constant lines) 302*a* and 302*b*. A ground (GND) plate 306 is disposed on the lower surface of the dielectric substrate 304. The microstrip lines 302*a* and 302*b* are closely disposed apart from each other at a gap G. The width of each microstrip line (302*a* and 302*b*) is W.

The switch electrode 312 is disposed between the microstrip lines 2*a* and 2*b* on the dielectric substrate 304. The switch electrode 312 is formed to have a height lower than that of each of the microstrip lines 302*a* and 302*b*. A driving voltage is selectively applied to the switch electrode 312 on the basis of an electrical signal. The switch movable element 308 is arranged above the switch electrode 312. The switch movable element 308 is made of a conductive member. A capacitor structure is therefore formed by the switch electrode 312 and switch movable element 308 opposing each other.

The support structure 310 for supporting the switch movable element 308 includes a post portion 310*a* and an arm portion 310*b*. The post portion 310*a* is fixed on the dielectric substrate 304 apart from the gap G between the microstrip lines 302*a* and 302*b* by a selected distance. The arm portion 310*b* extends from one end of the upper surface of the post portion 310*a* to the gap G. The support structure 310 is made of a dielectric, semiconductor, or conductor. The switch movable element 308 is fixed on a distal end of the arm portion 310*b* of the support structure 310.

Figure 4:
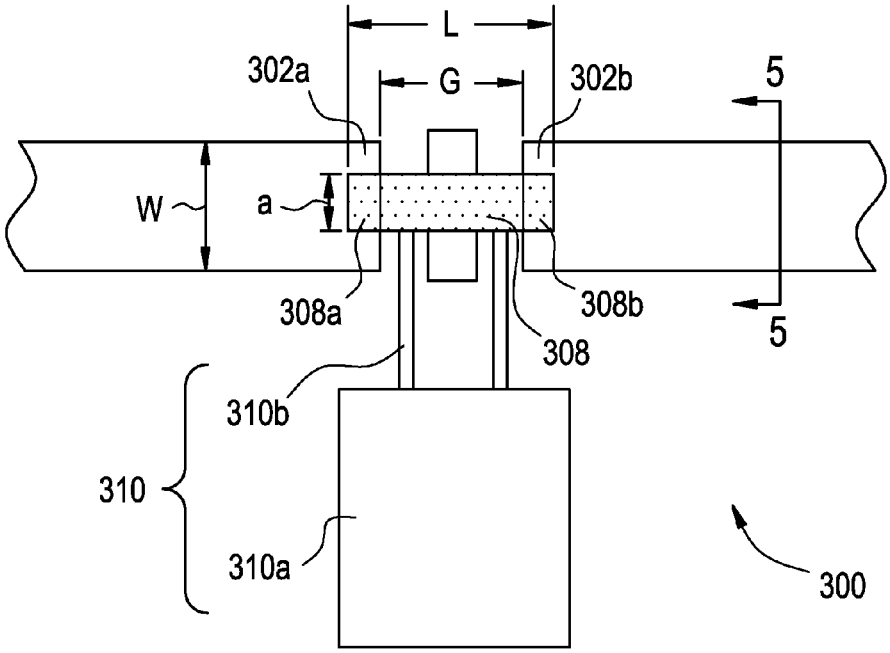
FIG. 4 is a cross-sectional view of the MEMS switch shown in FIG. 3 along section 4-4.

As shown in FIG. 4, the switch movable element 308 has a length L that is larger than the gap G. With this structure, distal end portions 308*a* and 308*b* of the switch movable element 308 oppose parts of distal end portions 302*a* and 302*b* of the microstrip lines 302*a* and 302*b*, respectively. The distal end portions 308*a* and 308*b* of the switch movable element 308 are defined as portions each extending by a length (L-G)/2 from a corresponding one of the two ends of the switch movable element 308. The distal end portions 302*a* and 302*b* of the microstrip lines 302*a* and 302*b* are defined as portions each extending by a length (L-G)/2 from a corresponding one of opposing ends of the microstrip lines 302*a* and 302*b*.

A width of the switch movable element 308 is smaller than the width W of each of the microstrip lines 302*a* and 302*b*. The area of each of the distal end portions 308*a* and 308*b* of the switch movable element 308 is therefore smaller than that of each of the distal end portions 302*a* and 302*b* of the microstrip lines 302*a* and 302*b*.

Figure 5A:
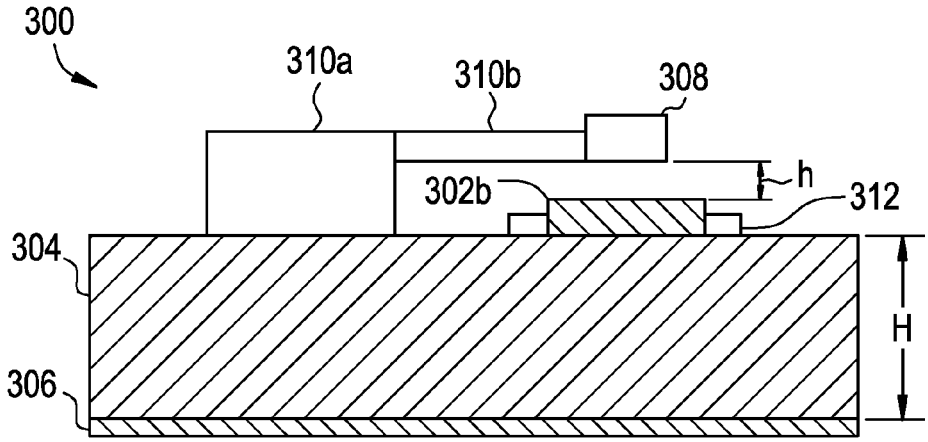
FIG. 5A illustrates a cross-sectional view along section 5-5 of the MEMS switch of FIG. 3 in an OFF state in accordance with an exemplary embodiment as disclosed herein.
Figure 5B:
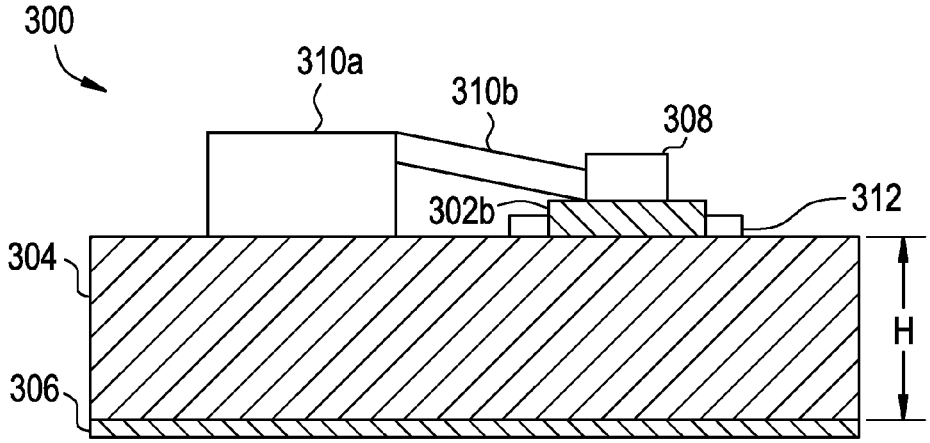
FIG. 5B illustrates a cross-sectional view along section 5-5 of the MEMS switch of FIG. 3 in an ON state in accordance with an exemplary embodiment as disclosed herein.

FIGS. 5A and 5B illustrate sectional views taken along section 5-5 of the MEMS switch 300 shown in FIG. 4, in (a) the OFF state (FIG. 5A), and (b) the ON state (FIG. 5B). As shown in FIG. 5A, the switch movable element 308 is generally positioned at a position separated from the microstrip lines 302*a* and 302*b* by a height h. In this case, the height (h) is approximately several micrometers (μm). If, therefore, no driving voltage is applied to the switch electrode 312, the switch movable element 308 is not in contact with the microstrip lines 302*a* and 302*b*.

However, the switch movable element 308 has the portions opposing the microstrip lines 302*a* and 302*b*. Since a capacitor structure is formed by switch moveable element 308 and these portions of microstrip lines 302*a* and 302*b*, the microstrip lines 302*a* and 302*b* are capacitively coupled to each other through the switch movable element 308. A capacitance between the switch movable element 308 and the microstrip lines 302*a* and 302*b* is proportional to the opposing area between the switch movable element 308 and microstrip lines 302*a* and 302*b*.

The switch movable element 308 is formed to have the width a smaller than the width W of each of the microstrip lines 302*a* and 302*b*, thereby decreasing the opposing area and the capacitance formed between the switch movable element 308 and opposing portions of microstrip lines 302*a* and 302*b*. Since this weakens the capacitive coupling between the microstrip lines 302*a* and 302*b*, energy leakage can be suppressed in the OFF state of the MEMS switch 300.

The MEMS switch 300 described above in FIGS. 3-5B is merely an exemplary embodiment of the construction of a MEMS switch that can be employed in the MEMS switch modules and diverter switch modules in accordance with exemplary embodiments of the present invention. It will be appreciated by those of ordinary skill in the art that the MEMS switch as described herein may be constructed in various other configurations. For example, the support structure 310 may include a membrane, a cantilever, a deflectable membrane, a diaphragm, a flexure member, a cavity, a surface micro-machined structure, a comb structure, a bridge, or the like. In exemplary embodiments where a membrane is used, the rest position of the membrane may correspond to the OFF/ON state, and any deflection experienced by the membrane may cause the switch to flip to the opposite state.

The size and scalability of the MEMS switches used as switching components in the OLTC advantageously facilitate ease in packaging. Furthermore, the use of MEMS switches advantageously eliminates the need for immersing the on-load tap changer in an enclosure with insulating media such as oil or SF6 gas as typically done for conventional OLTC switches. It is contemplated that the OLTC with MEMS switching technology can be housed in an air-filled enclosure apart from the transformer unit, making the OLTC more easily available for maintenance. The MEMS switches used herein provide simplicity for designers since MEMS switches are real mechanical switches without the problems typically associated with conventional mechanical switches currently used in conventional on-load tap changers.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An on-load tap changer for a transformer winding, comprising:

a first micro-electromechanical system (MEMS) switch module directly coupled in series with a first tap on the transformer winding and a neutral terminal;

a second MEMS switch module directly coupled in series with a second tap on the transformer winding and the neutral terminal; and a controller operably coupled to the first MEMS switch module and the second MEMS switch module, the controller is configured to generate a first and second signal to be received by the first and second MEMS switch modules respectively to induce the first MEMS switch module to transition to a closed position and induce the second MEMS switch module to transition to an open position to obtain a first predetermined turns ratio on the transformer winding at a first time, the controller further configured to generate a third signal to the second MEMS switch module to induce the second MEMS switch module to transition to a closed position at a second time after the first time, the controller further configured to generate a fourth signal to be received by the first MEMS switch module at a third time after the second time, the first MEMS switch module configured to transition from the closed position to an open position at a detected zero crossing of an alternating current in response to the fourth signal to obtain a second predetermined turns ratio on the transformer winding;

control circuitry coupled to the first MEMS switch module and the second MEMS switch module, the control circuitry configured to prevent the creation of high circulating current between transformer windings when the first MEMS switch module and the second MEMS switch module are each in the closed position, and wherein at least one of the first MEMS switch module or the second MEMS switch module includes a current sensor for detecting the zero crossing of the alternating current.

2. The on-load tap changer as in claim 1, wherein the control circuitry comprises a first diverter switch module coupled between the first MEMS switch module and the neutral terminal and further coupled between the second MEMS switch module and the neutral terminal, the first diverter switch module is configured to transition to a first operational position at the first time to enable load current to pass between the first MEMS switch module and the neutral terminal and to obtain the first predetermined turns ratio for the transformer winding.

3. The on-load tap changer as in claim 2, wherein the control circuitry further comprises a second diverter switch module coupled between the first MEMS switch module and the first diverter switch module, the second diverter switch module coupled in parallel with a first diverter impedance, the second diverter switch module is configured to transition to an open position at a fourth time after the second time in response to a fifth signal generated by the controller to enable load current to pass through the first diverter impedance during a tap switching operation, the second diverter switch module is in a closed position at the first time.

4. The on-load tap changer as in claim 3, wherein the control circuitry further comprises a third diverter switch module coupled between the second MEMS switch module and the first diverter switch module, the third diverter switch module coupled in parallel with a second diverter impedance, the third diverter switch module is in an open position at the fourth time.

5. The on-load tap changer as in claim 4, wherein the control circuitry further comprises a fourth diverter switch module coupled between the first diverter impedance and the second diverter impedance and further coupled in parallel with the first diverter switch module, the fourth diverter switch module is configured to transition to a closed position at a fifth time after the fourth time in response to a sixth signal generated by the controller to enable load current to pass through the first diverter impedance and the second diverter impedance preventing the creation of high circulating current between transformer windings during the tap switching operation, the fourth diverter switch module is in an open position at the first time.

6. The on-load tap changer as in claim 5, wherein the first diverter switch module is configured to transition from the first operational position to a second operational position at a sixth time after the fifth time in response to a seventh signal generated by the controller to enable load current to pass between the second MEMS switch module and the neutral terminal and to obtain the second predetermined turns ratio for the transformer winding.

7. The on-load tap changer as in claim 6, wherein the fourth diverter switch module is configured to transition to the open position at a seventh time after the sixth time in response to an eighth signal generated by the controller to enable current load to pass through the second diverter impedance during the tap switching operation.

8. The on-load tap changer as in claim 7, wherein the third diverter switch module is configured to transition to a closed position at an eighth time after the seventh time in response to a ninth signal generated by the controller to enable load current to pass between the second MEMS switch module and the neutral terminal and provide the transformer winding with the second predetermined turns ratio.

9. The on-load tap changer as in claim 8, wherein the first MEMS switch module transitions from the closed position to the open position at the detected zero crossing of the alternating current in response to the fourth signal to obtain the second predetermined turns ratio on the transformer winding at the third time.

10. The on-load tap changer as in claim 1, wherein the first and second MEMS switch modules each include at least one MEMS switch that operably has zero leakage while in the open position.

11. The on-load tap changer as in claim 1, wherein the first and second MEMS switch modules each have switching speeds of less than one microsecond.

12. The on-load tap changer as in claim 1, wherein the first and second MEMS switch modules each include at least one current sensor for detecting a zero crossing of the alternating current.

13. An on-load tap changer for a transformer winding, comprising:

a first micro-electromechanical system (MEMS) switch module directly coupled in series with a first tap on the transformer winding and a neutral terminal;

a second MEMS switch module directly coupled in series with a second tap on the transformer winding and the neutral terminal;

a controller operably coupled to the first MEMS switch module and the second MEMS switch module, the controller is configured to generate a first and second signal to be received by the first and second MEMS switch modules respectively to induce the first MEMS switch module to transition to a closed position and induce the second MEMS switch module to transition to an open position to obtain a first predetermined turns ratio on the transformer winding at a first time, the controller further configured to generate a third signal to the second MEMS switch module to induce the second MEMS switch module to transition to a closed position at a second time after the first time; and control circuitry coupled to the first MEMS switch module and the second MEMS switch module, the control circuitry configured to prevent the creation of high circulating current between transformer windings when the first MEMS switch module and the second MEMS switch module are each in the closed position, wherein the controller is further configured to generate a fourth signal to be received by the first MEMS switch module at a third time after the second time, the first MEMS switch module configured to transition from the closed position to an open position at a detected zero crossing of an alternating current in response to the fourth signal to obtain a second predetermined turns ratio on the transformer winding, and wherein the first MEMS switch module includes a first current sensor for detecting the zero crossing of the alternating current.

14. The on-load tap changer as in claim 13, wherein the second MEMS switch module includes a second current sensor for detecting the zero crossing of the alternating current.

15. The on-load tap changer as in claim 14, wherein the first current sensor is integral to the first MEMS switch module and the second current sensor is integral to the second MEMS switch module.

16. The on-load tap changer as in claim 13, wherein the first and second MEMS switch modules each include at least one MEMS switch that operably has zero leakage in the open position.

17. The on-load tap changer as in claim 13, wherein the first and second MEMS switch modules each have switching speeds of less than one microsecond.

* * * * *